US005346053A

United States Patent [19]

Dorn

[11] Patent Number: 5,346,053

[45] Date of Patent: Sep. 13, 1994

[54] MODULAR SCREEN SYSTEM FOR SCREENING DECK

[76] Inventor: Lloyd A. Dorn, 3008 NE. Washougal River Rd., Washougal, Wash. 98671

[21] Appl. No.: 104,711

[22] Filed: Aug. 11, 1993

Related U.S. Application Data

[62] Division of Ser. No. 843,637, Feb. 28, 1992, Pat. No. 5,248,043.

[51] Int. Cl.[5] ..... B07B 1/49

[52] U.S. Cl. ..... 198/399; 198/405

[58] Field of Search ..... 209/395, 399, 405, 409, 209/412, 414

[56] References Cited

U.S. PATENT DOCUMENTS

| | | | |
|---|---|---|---|
| 4,670,136 | 6/1987 | Schmidt et al. | 209/399 X |
| 4,882,044 | 11/1989 | Freissle | 209/399 X |
| 4,885,040 | 12/1989 | Wolff | 209/399 X |
| 5,049,262 | 9/1991 | Galton et al. | 209/399 |
| 5,112,475 | 5/1992 | Henry, Jr. | 209/399 |
| 5,213,217 | 5/1993 | Galton et al. | 209/399 |
| 5,248,043 | 9/1993 | Dorn | 209/399 |

FOREIGN PATENT DOCUMENTS

| | | | |
|---|---|---|---|
| 0167999 | 1/1986 | European Pat. Off. | 209/399 |
| 3606854 | 9/1987 | Fed. Rep. of Germany | 209/399 |
| 752229 | 3/1976 | South Africa | 209/399 |
| 0000341 | 6/1979 | World Int. Prop. O. | 209/399 |

*Primary Examiner*—D. Glenn Dayoan

*Attorney, Agent, or Firm*—Robert L. Harrington

[57] ABSTRACT

A screening deck is shown and described including an intermediate frame structure mountable to the screening deck in a manner similar to that of an original screen component, but providing mounting formations for attachment of a plurality of screen modules thereon. The screening deck need not be modified in order to receive the intermediate frame. The intermediate frame may be applied to either a crowned screening deck or a flat screening deck. In the crowned configuration, the intermediate frame takes a form similar to the original screen, but includes mounting rails for receiving the screen modules. In the flat screening deck configuration, individual intermediate frame components mount along the longitudinal support beams and provide formations for mounting of screen components thereon. In each illustrated embodiment, individual screen components are mounted and dismounted without separate fastening elements and enjoy support along at least two edges thereof.

5 Claims, 6 Drawing Sheets

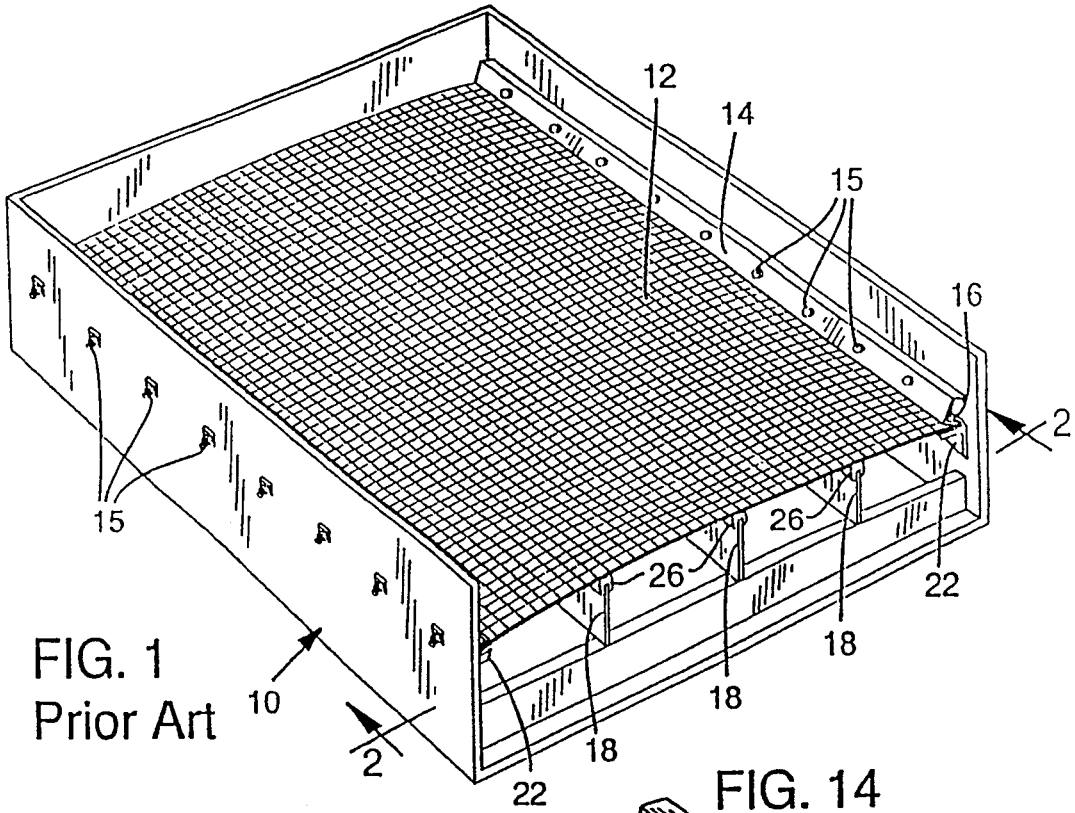
FIG. 1
Prior Art
FIG. 14
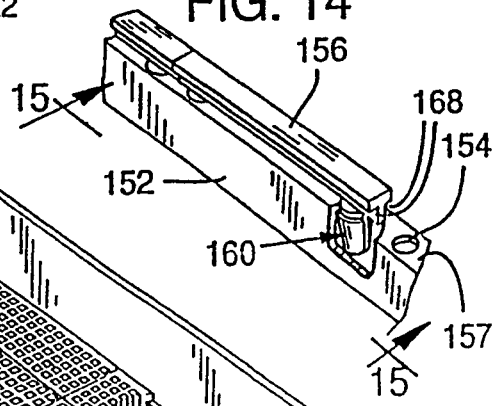
FIG. 13
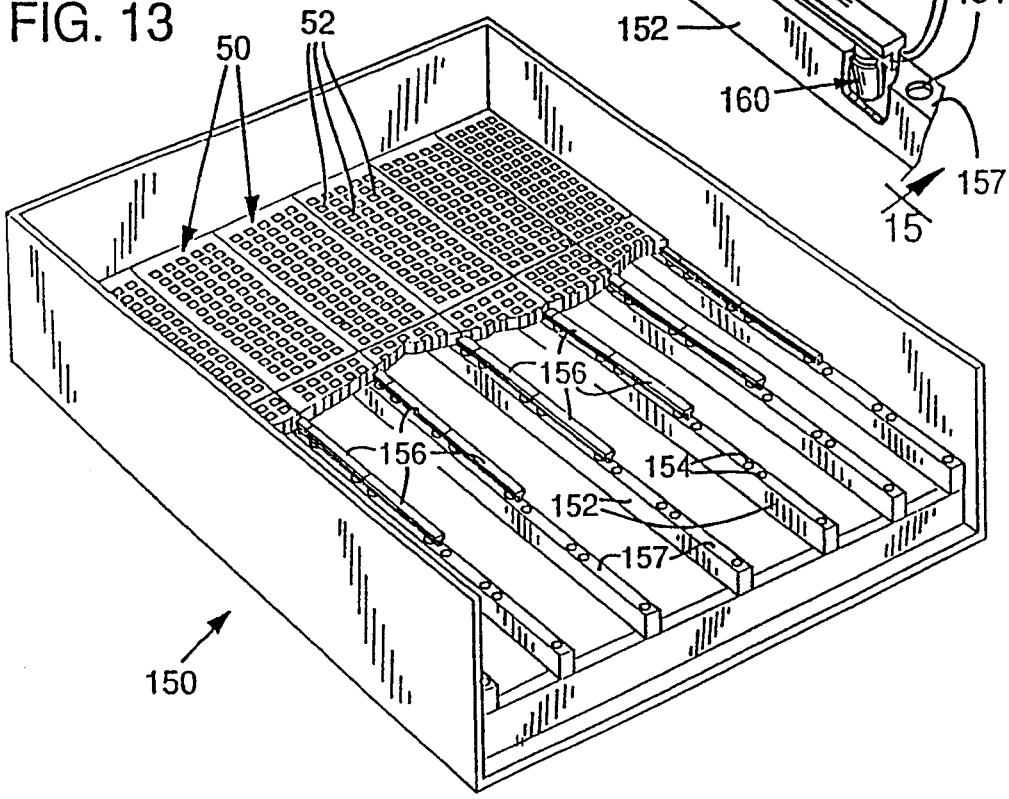

MODULAR SCREEN SYSTEM FOR SCREENING DECK

This is a divisional of copending application(s) Ser. No. 07/843,637 filed on Feb. 28, 1992 which is now U.S. Pat. No. 5,248,043.

BACKGROUND INFORMATION

1. Field of the Invention

This invention relates generally to screening decks for screening particulate material and particularly to an apparatus and method for mounting modular screens on a screening deck without altering the deck structure.

2. Background of the Invention

Crowned screening decks are prevalent in industries segregating particulate matter, e.g., gravel, by size. The screen is typically a lattice of resilient, high strength, wear resistant wire providing a selected screen aperture size. The screen extends across the full width of the deck. Longitudinal support beams of uneven height support the screen and define a radius of curvature for the crown. The screen, which has formed hooks or the like along each side, is tensioned and forced to conform to the crown by attachment at longitudinal side clamps of the deck. This assures that the screen bears tightly against the support beams to maintain the crown and to minimize wear between the beams and the screen.

The screen does not always wear uniformly. An entire screen is replaced even for excess wear only in a small area or for localized damage during use. The screen itself is expensive and the changeover is tedious and time consuming. The longitudinal side clamps, which have multiple bolt fasteners, must be removed before the screen can be removed and replaced. To avoid the cost and down-time associated with replacing an entire screen, screening decks often employ modular screen components. Thus, a large screen is replaced with multiple small screens or modules covering the entire screening deck, but which may be individually replaced upon the occurrence of localized wear or damage. Generally, such modular screen systems have been applied to flat screening decks, i.e., a screening deck with support beams of even height defining a flat screen area as opposed to a crowned screening area.

A plank type screening system disclosed by Trelleborg in International Publication No. W083/02075 as published Jun. 23, 1983 under the Patent Cooperation Treaty. The screens of the Trelleborg system must extend the full width of the screening deck and clamp down at the side clamps of the deck in a manner similar to that of the full width crowned screen. The clamps must be removed from the sides of the deck when removing and replacing a screen. The clamps, however, typically hold several screens and the release of one pair of side clamps releases all screens held by those clamps. Thus, in replacing a single screen of the Trelleborg system several screens are necessarily unclamped, and may require repositioning in reassembly of the system.

Small individual screen modules, i.e., less than the full width of the screening deck, have been utilized- The individual screen modules cannot mount to the crowned deck in the same manner as that of the full width crowned screen or that of the plank type module. The support structure of the crowned deck, therefore, must be replaced or altered in order to accept the smaller screen modules. Generally, such modification converts the crowned screening deck to a flat screening deck. In other words, the longitudinal support beams are converted to or replaced with support beams of even height. Also, lateral support beams are, in some cases, are added between the longitudinal support beams to complete a matrix-like support structure for receiving screen modules. The new beams have mounting holes for receiving fasteners for holding individual screen modules. Screening decks rarely have width dimensions matching an even multiple of the screen module width. Accordingly, in converting a crowned screening deck into a screening deck for receiving screen modules, the conversion must include fortification along the side walls and extending toward the center of the screening deck to fill in the side gaps therealong left by a matrix of screen modules not filling the entire screening deck width. While the deck alteration provides the capability of accepting modular screens, such alteration may void the manufacturer's warranty. In addition, the altered deck is no longer a crowned screening deck and is no longer useable with the full width tensionable screens.

Various fasteners have been developed to attach the screen modules to the support beams. Most of the fasteners are separate from the screen modules and are easily damaged, dropped, misplaced or lost in the process of screen changeover. Generally, such fasteners have been point-to-point attachments, e.g., as by engaging the screen module by mounting pins or plugs at the screen module corners and provide no freedom of mounting position. U.S. Pat. No. 4,661,245 issued Apr. 28, 1987 to Rutherford et al shows a modular screen assembly with downward protruding formations coupling to corresponding formations of the underlying screen deck.

BRIEF SUMMARY OF THE INVENTION

The present invention is a system of applying modular screens to both crowned and flat screening deck configurations. The system utilizes an intermediate frame removably mountable to the screening deck. The modular screens then removably mount to the intermediate frame without the need of auxiliary fasteners.

In one embodiment of the invention, an intermediate frame mounts to a crowned deck in the manner of a conventional full width screen, i.e., attaches to the existing longitudinal side clamps of the deck. The intermediate frame is tensioned and forced to conform to the crown of the existing support beams. A plurality of individual screen modules removably mount to the intermediate frame and complete the assembly. The longitudinal side clamps need not be disturbed to remove, replace or re-install any one of the screen modules. The intermediate frame has support rails extending the full width of the deck transverse to the longitudinal support beams of the deck. The support rails of the frame are spaced according to the dimensions of the screen modules. The support rails have a sectional profile complementary to edge mounting formations of the modular screens. The modular screens are pliable and mount to the intermediate frame by engagement of the support rail profile and edge mounting formations of the screen modules. As a result of this mounting arrangement, the screen modules enjoy support fully along at least two opposing edges. Screen modules are removed by flexing the module to release the module from the support rails. The intermediate frame thereby adapts a crowned deck to a modular screen system without altering the basic crowned deck structure.

In another embodiment, a plurality of intermediate frame members attach along the longitudinal support beams of a flat screening deck. The intermediate frame members attach to the flat deck beams without auxiliary fasteners. The frame members have self locking plugs that positively engage pre-existing apertures of the support beams. The modular screens then removably mount to the rails of the intermediate frame members.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which:

FIG. 1 is a perspective view of a prior art crowned screening deck with a full width screen mounted directly to the deck;

FIG. 13 illustrates a second embodiment of the present invention as applied to flat screening decks;

FIG. 14 is an enlarged detailed view of an intermediate frame component of the screening deck of FIG. 13;

DETAILED DESCRIPTION OF THE PREFERRED EMBODIMENT

Figure 2:
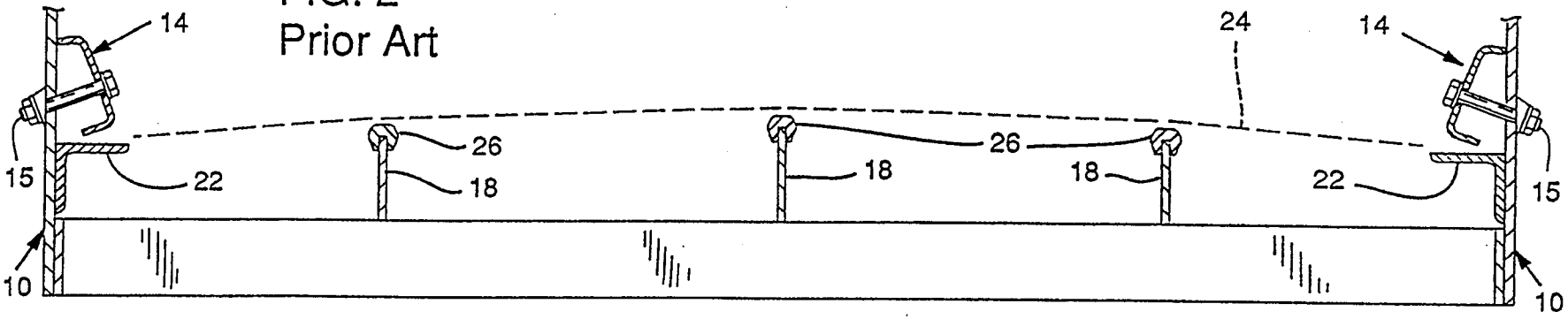
FIG. 2 Prior Art
FIG. 2 is an end view of the prior art deck as taken along lines 2—2 of FIG. 1, but with the screen removed.

FIGS. 1 and 2 illustrate a prior art crowned screening deck 10 and a full width screen 12. The screen 12 attaches to the deck 10 by longitudinal side clamps 14 engaging formed hooks 16 at the edges of the screen 12. The clamps 14 tension and force the screen 12 to conform to the crown of the deck 10. In FIG. 2, the crown or radius of curvature of the deck 10 follows the uneven heights of the longitudinal support beams 18 and the side brackets 22. The crown has a radius of curvature indicated by the dashed arc 24. The screen 12 is tensioned and forced against the beams 18 and the brackets 22 by tightening bolts 15 of clamps 14 to secure the screen 12 against movement relative to either the beams 18 or the brackets 22. The beams 18 have a resilient material 26 along the length of their upper surfaces to assure that the screen 12 is well secured against beams 18. The resilient material 26 accommodates any tolerance variations in beam 18 height or screen 12 deformations relative to arc 24.

As may be appreciated, the screening deck 10 agitates in some fashion to provide vibrating movement of the screen 12 whereby particulate matter upon the screen 12 is similarly agitated. Screening deck 10 is typically inclined to provide longitudinal movement of a mass of particulate matter on the vibrating screening deck 10. Particles smaller than the apertures of the screen 12 fall through the screen 12 and are thereby separated.

Figure 3:
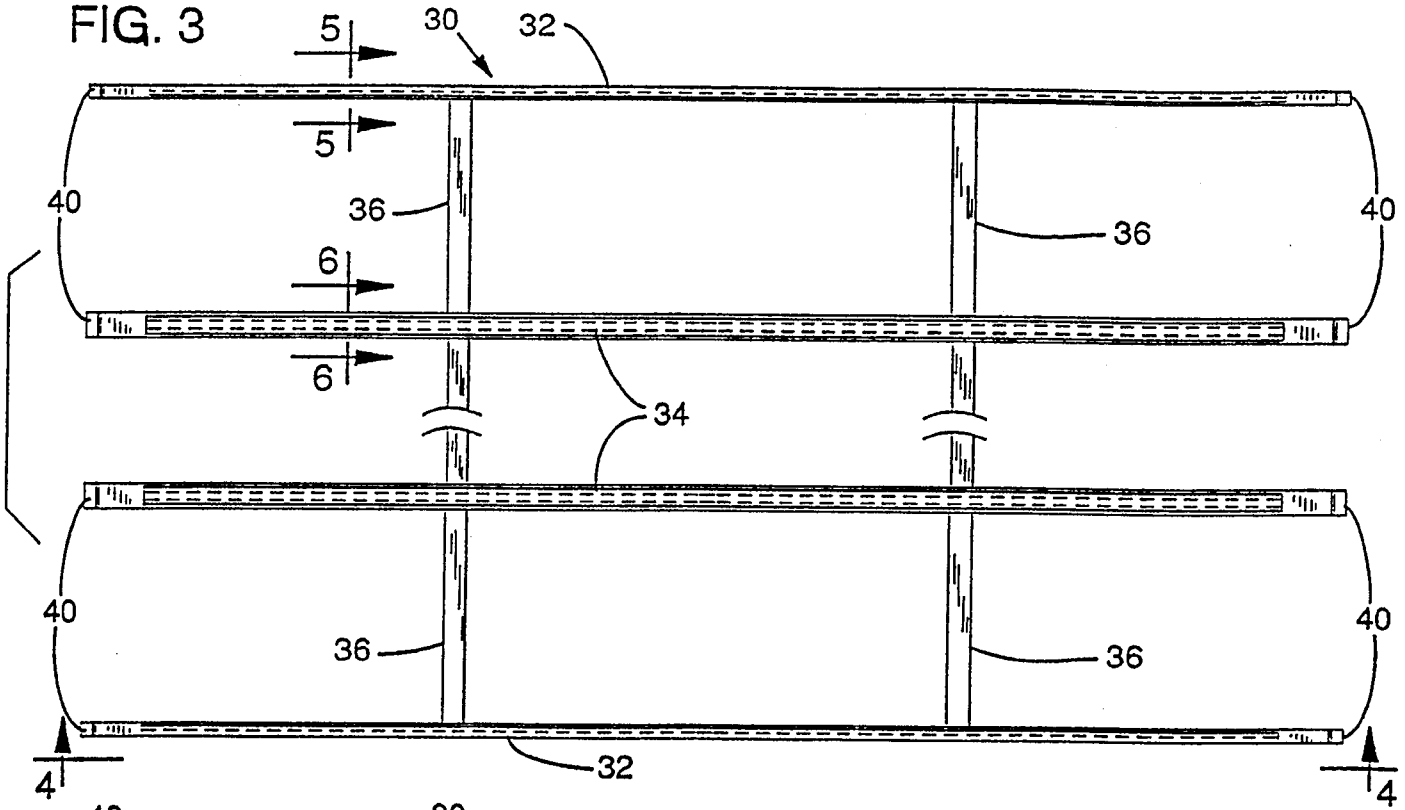
FIG. 3 is a top view of an intermediate frame according to a first embodiment of the present invention and adapted for use in connection with the screening deck of FIG. 1.
Figure 4:
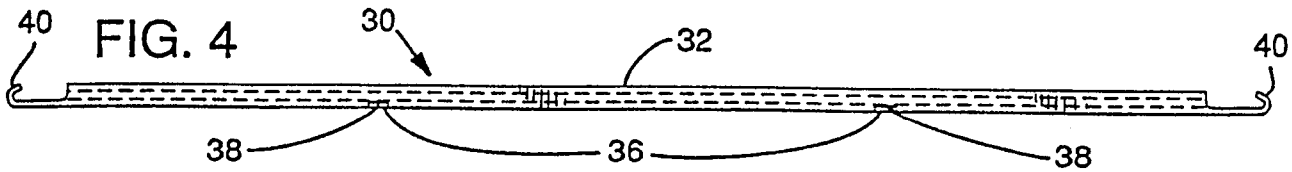
FIG. 4 is an end view of the intermediate frame as taken along lines 4—4 of FIG. 3.
Figure 5:
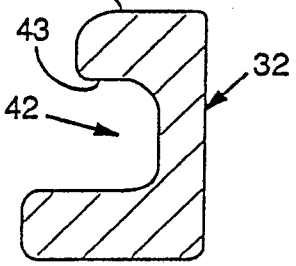
FIGS. 5 and 6 show sectional views of end and interior rails of the intermediate frame of FIG. 3 as taken along lines 5—5 and 6—6, respectively, of FIG. 3.
Figure 6:
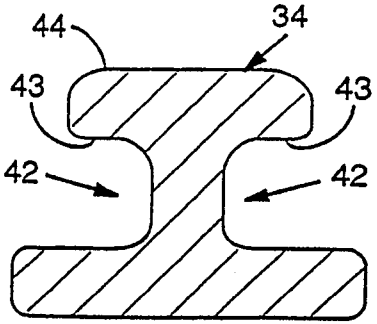

FIGS. 3–6 illustrate an intermediate frame 30 mountable on the deck 10 of FIG. 1 in place of the screen 12. The frame 30 is suitably constructed, of material such as aluminum or steel, to allow for tensioned mounting along the arc 24. The frame 30 has end rails 32 (FIGS. 3 and 5) and multiple interior rails 34 (FIGS. 3 and 6). Spacer bars 36 maintain in spaced relation the rails 32 and 34. The recess formations 38 (FIG. 4) of rails 32 and 34 accommodate integral mounting of the spacer bars 36 within the structure of frame 30. Formed hooks 40 (FIG. 4) at each end of the rails 32 and 34 facilitate mounting of the intermediate frame 30 on the deck 10 in the manner of screen 12. More particularly, hooks 40 correspond to the hooks 16 of screen 12 and couple to the longitudinal side clamps 14 for tensioning the intermediate frame 30 across the beams 18 of screening deck 10. Thus, it may be appreciated that the intermediate frame 30 is securely mounted to and conforms to the crown of the screening deck 10 without modification to the screening deck 10.

The view of FIG. 5 shows the sectional profile of the end rails 32. Each rail 32 has a recess 42 extending along the length of its inward facing side, except for the length portions near hooks 40. Recess 42 defines a downward facing shoulder 43. Each rail 32 includes an upward facing surface 44. FIG. 6 shows the sectional profile of the interior rails 34 with a similar recess 42, but formed along the length of both sides. Thus, each rail 34 includes, on opposite sides, downward facing shoulders 43, and an upward facing surface 44.

The intermediate frame 30 may be constructed by welding together the various elements- In such construction, the structure of the screening deck 10 is considered in accommodating mounting of the intermediate frame 30 in the fashion of the screen 12. More particularly, the spacer bars 36 should be positioned so as to avoid the beams 18. Also, the spacing between adjacent ones of rails 32 and 34 corresponds to the dimensions of screen modules, described hereinafter, to be mounted upon the intermediate frame 30.

Figure 7:
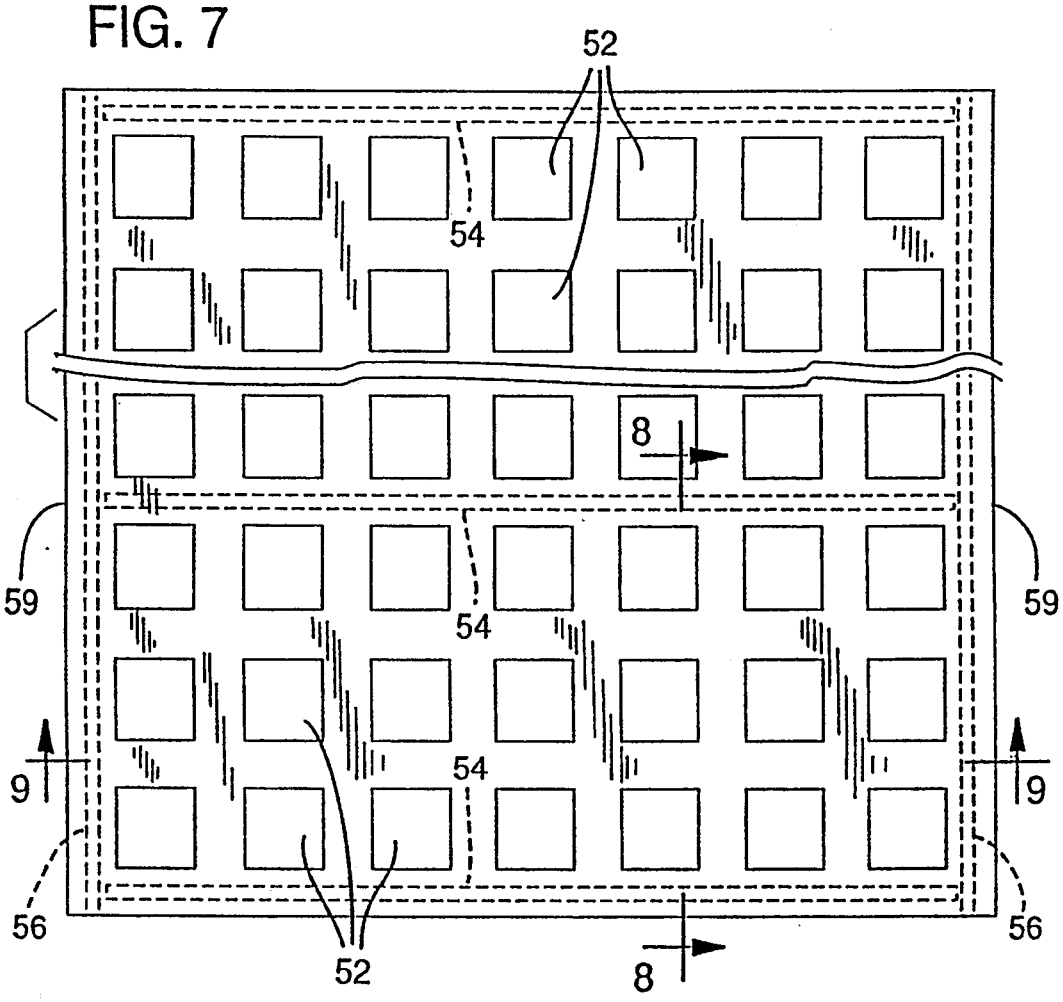
FIG. 7 is a top view of a modular screen for use in connection with the intermediate frame of FIG. 3.
Figure 8:
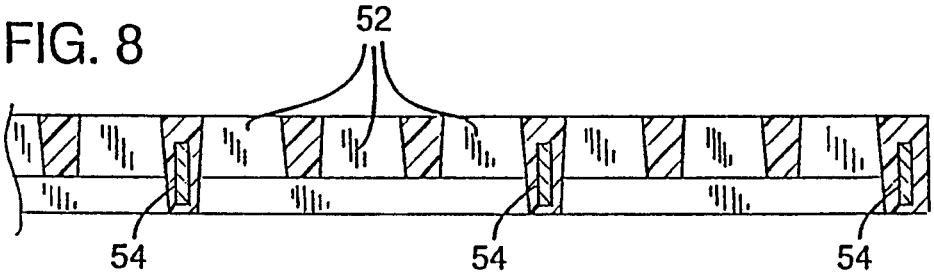
FIGS. 8 and 9 are sectional views of the modular screen of FIG. 7 as taken along lines 8—8 and 9—9, respectively, of FIG. 7.
Figure 9:
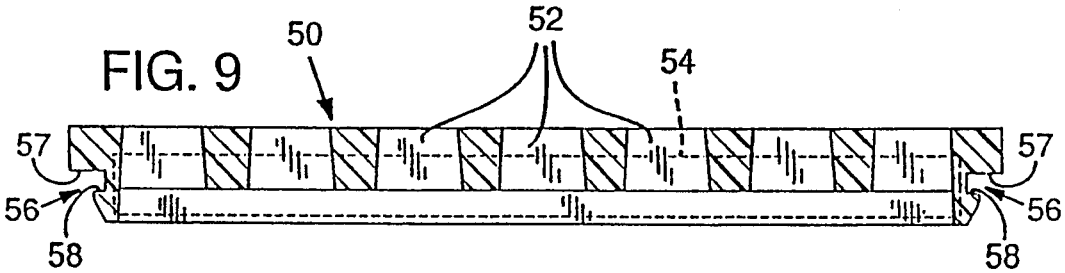

FIG. 7 is a top view of a screen module 50 including screen apertures 52 of given size, i.e., according to a selected screening function where material smaller than apertures 52 falls through screen modules 50 and is thereby separated from material larger than apertures 52. FIGS. 8 and 9 show sectional views of the screen module 50 as taken along lines 8—8 and 9—9, respectively, of FIG. 7. In FIGS. 7—9, each screen module 50 includes interior support reinforcing members 54 within each modular screen 50. The modules 50 are constructed by molding process including integration of the reinforcing members 54 therein. Screen modules 50 are constructed from a variety of materials, all well known in the art.

The reinforcing members 54 lie in parallel relation and allow crowning of the modular screens 52 according to the arc 24 when mounted on the screening deck 10, but resist deformation of modules 50 in the transverse direction- With reference to FIG. 9, each screen module 50 includes edge mounting formations 56 corresponding to the sectional profiles of rails 32 and 34, i.e., the mounting formations 56 and sectional profiles of rails 32 and 34 are complimentary in shape. More particularly, the formations 56 include downward facing surfaces 57 and upward facing shoulders 58. The surfaces 57 rest against the upward facing surfaces 44 of rails 32 and 34. The shoulders 58 of modules 50 engage the downward facing shoulder 43 of rails 32 and 34. The modules 50 are pliant and may be urged into position by virtue of such pliancy. Thus, each of modules 50 is supported fully along opposite edges 59 which are coerced into the arc 24 by virtue of mounting to the crowned rails 32 and 34. Also, the screen modules 50 may be selectively positioned laterally along the rails 32 and 34. The edge mounting configuration of modules 50 and the uniform profile along the length of rails 32 and 34 allows mounting of a given module 50 at a selected lateral position. The apertures 52 of adjacent modules 50 may be thereby laterally staggered from module to module relative to a longitudinal path through the screening deck 10. This improves the possibility that the particles, which move generally along longitudinal paths, will encounter the apertures 52. Additionally, any given module 50 may be cut along a longitudinal line and thereby have a selected width, the only restriction in dimension for modules 50 being the length dimension defined by the spacing between rails 32 and 34. Accordingly, in applying the modules 50 to a given screening deck the full width of the screening deck is utilized by such longitudinal cutting of modules 50 as necessary to occupy the full screening deck width, and as necessary to laterally stagger the apertures 52. The screen modules 50 are thereby securely and selectively positioned along the arc 24 and follow closely the vibration of screening deck 10.

Figure 10:
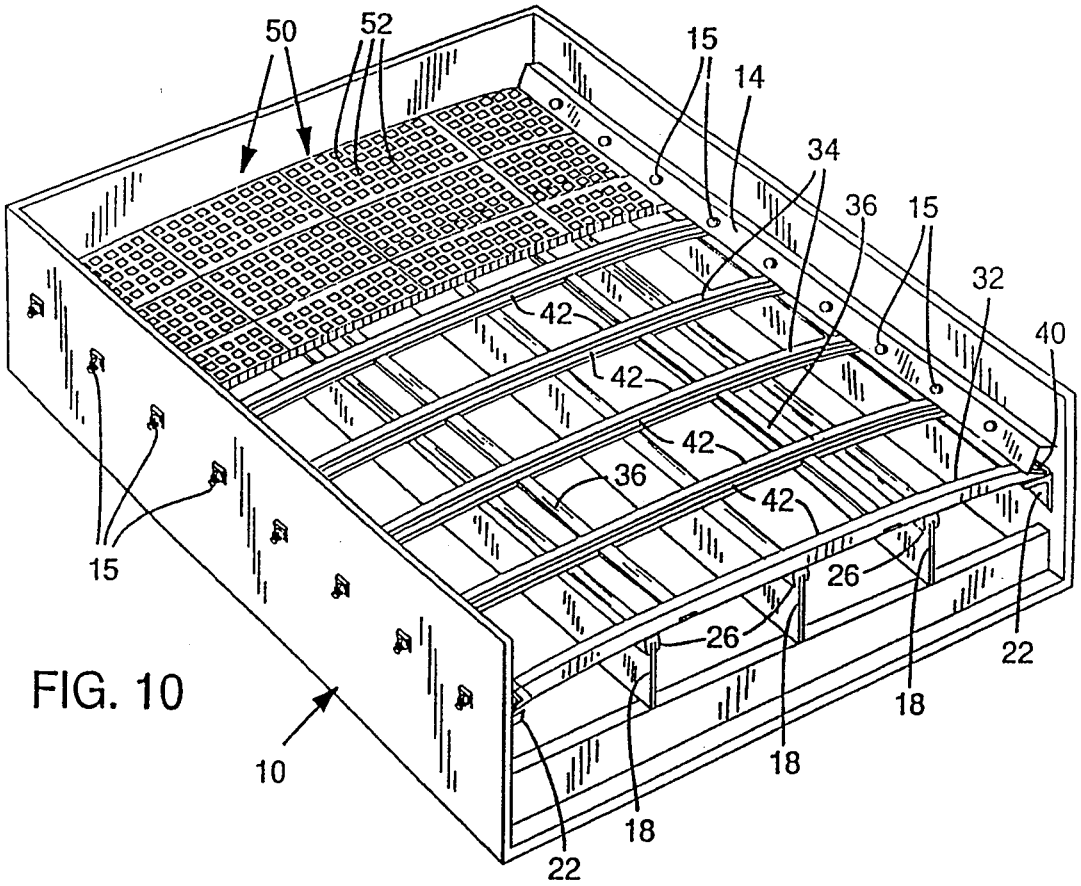
FIG. 10 is a perspective view partially broken away of a complete screening deck incorporating the intermediate frame of FIG. 3 and modular screens of FIG. 7.
Figure 11:
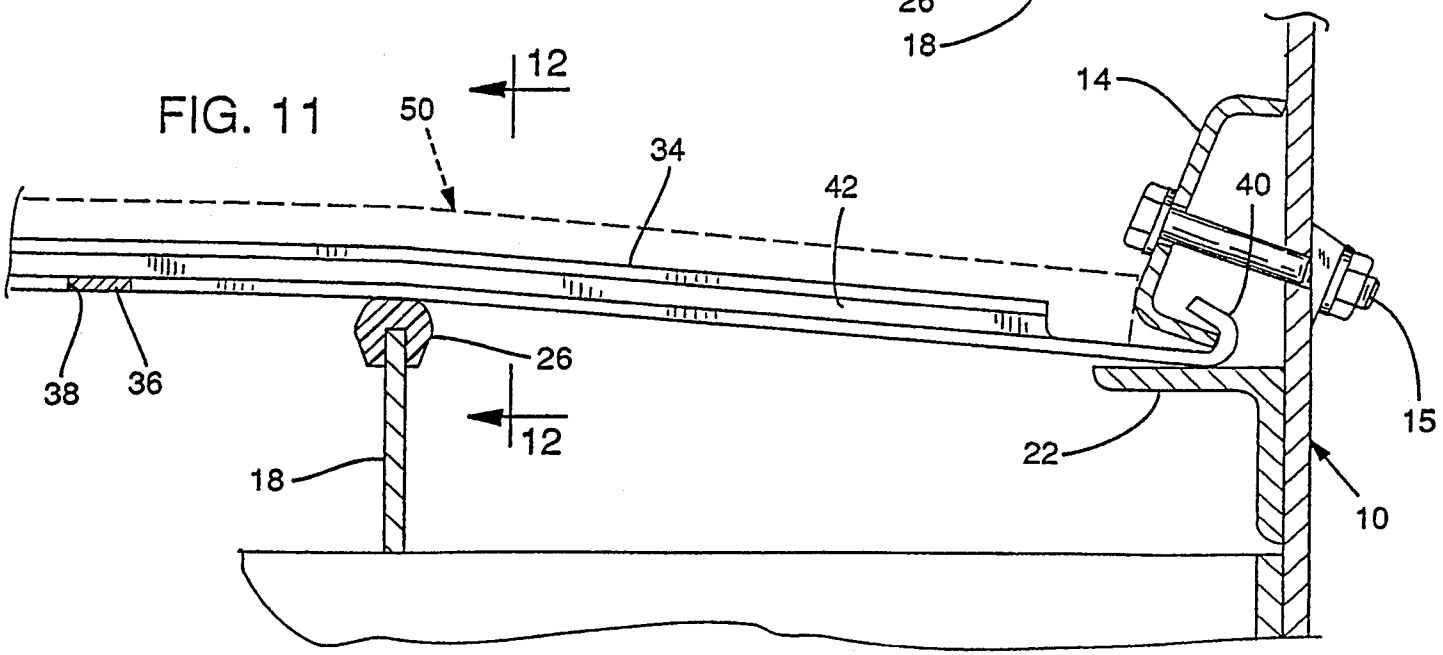
FIG. 11 is an enlarged partial sectional view showing attachment of the intermediate frame of FIG. 3 to the screening deck of FIG. 10.

FIG. 10 illustrates the screening deck 10 of FIG. 1, but with the intermediate frame 30 attached thereto in the manner of the screen 12 and with some screen modules 50 (some partially broken away) attached to the rails 32 and 34 of frame 30. In FIG. 11, the frame 30 mounts with the rails 32 and 34 transverse to the support beams 18 of the deck 10. The longitudinal side clamps 14 of the deck 10 engage the hooks 40 of the rails 32 and 34 to tension and force the frame 30 to conform to the crown of the deck 10.

Figure 12:
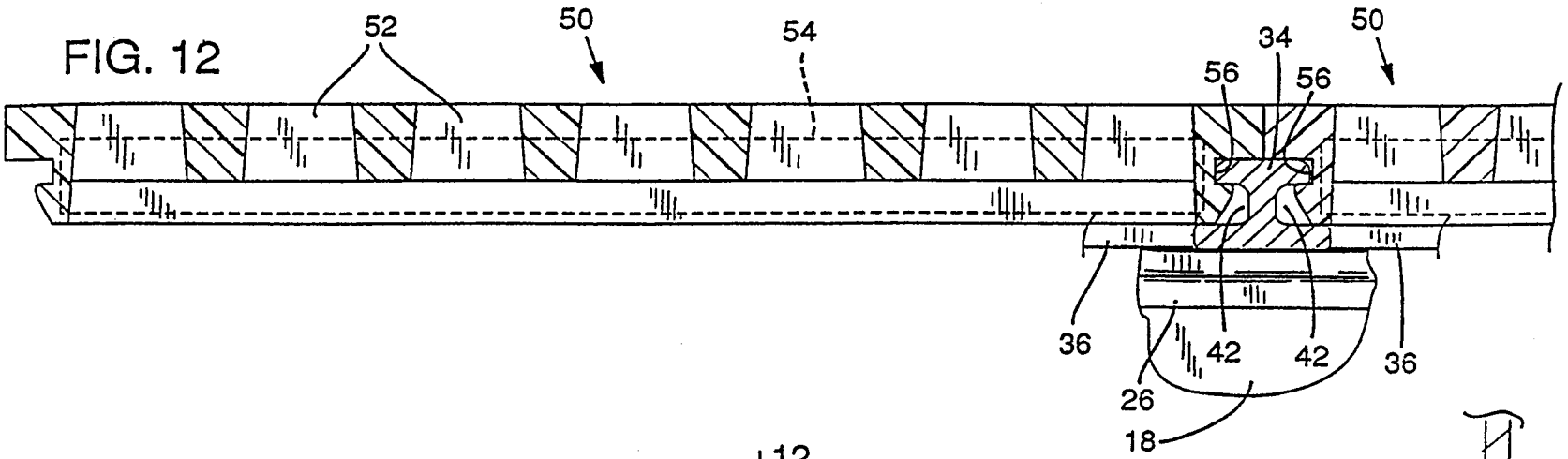
FIG. 12 is a sectional view of the intermediate frame and modular screen components as taken along lines 12—12 of FIG. 11.

FIG. 12 illustrates the attachment of screen modules 50 to the intermediate frame 30 as well as the abutment of individual screen modules 50 at the interior rails 34. The support members 54 lie parallel to the longitudinal beams 18 of the screening deck 10 and allow crowning of the screen modules 50. Each screen module 50 is held in place by edge engagement with two of the rails of the intermediate frame 30. FIG. 12 illustrates the abutment of two screen modules 50 and edge mounting at one of intermediate rails 34. The edge formations 56 of each screen module 50 are supportingly engaged along the recess 42 and upper surface 44 of rail 34. As may be appreciated, the end rails 32 provide similar mounting, but require only one inward facing recess 42 to suitably engage the outward facing edge formations 56 of screen modules 50.

In operation, the screening deck 10 is easily converted to a modular screening deck by first removing the screen 12 and mounting the intermediate frame 30. The individual screen modules 50 are then mounted to the frame 30 to complete the assembly. The screening deck is then ready for operation. Should localized wear or damage occur to one or more of the screen modules, that screen module or modules may be replaced without significant dismantling of the screening deck 10. Also, by allowing mounting of individual screen modules 50, more control over the screening function may be provided. For example, the system allows greater flexibility by allowing mounting of screen modules 50 with selected longitudinal gradation in aperture 52 size to accomplish a given screening function.

FIGS. 13–16 illustrate a second embodiment of the present invention as applied to a flat screening deck 150. In conventional use, the screening deck 150 includes longitudinal beams 152 of even height defining a flat screen area. Each rail 152 includes a plurality of mounting apertures 154. In accordance with the present invention, intermediate frame components 156 attach to and along the rails 152 at the apertures 154 by way of downward protruding self-locking plugs 160. The intermediate frame components 156 have sectional profiles that provide, in combination with the upper surface 157 of beams 152, recesses 168. The intermediate frame components 156 lying along the outside edges of the screening deck need only provide one half the profile of those frame components 156 interior of screening deck 150 as only an inward facing recess 168 is required at the outside edges of the screening deck 150. The intermediate frame components 156 may be formed from a variety of materials including aluminum, steel, and plastics materials of suitable grade for such application.

Figure 16:
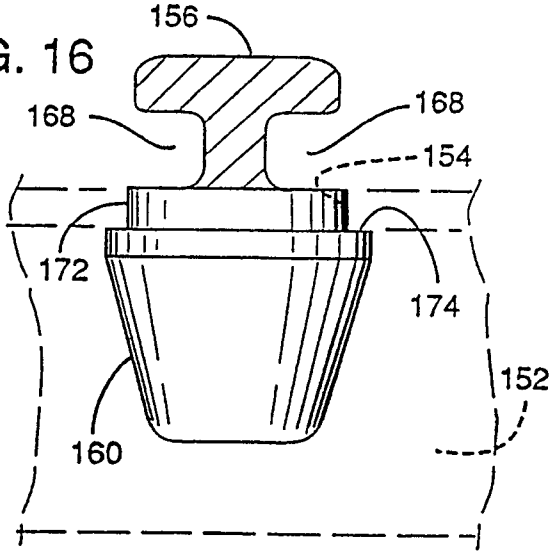
FIG. 16 is a sectional view of the intermediate frame component of FIG. 15 as taken along lines 16—16 of FIG. 15.
Figure 15:
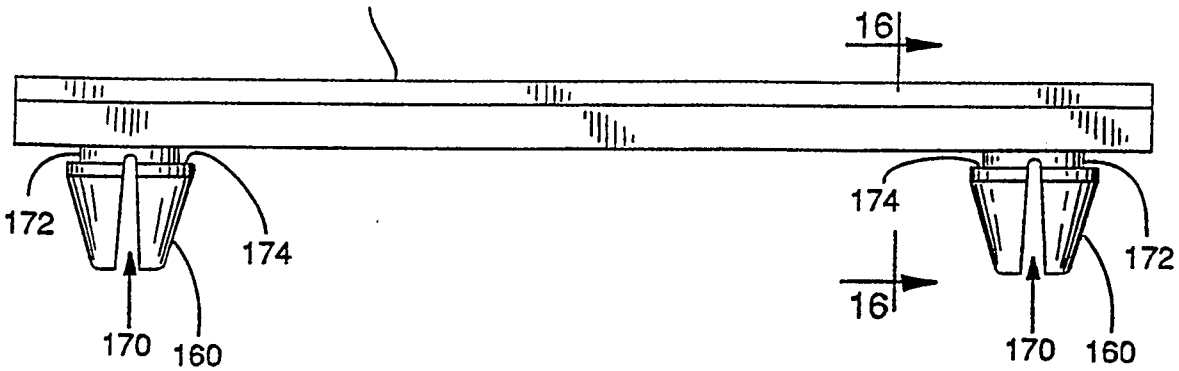
FIG. 15 is a side view of the intermediate frame component of FIG. 14 as taken along lines 15—15 of FIG. 14.

The recesses 168, generally similar to the recesses 42 of FIGS. 5 and 6, allow mounting of the screen modules 50 upon the intermediate frame member 156 in a manner similar to that of the first described embodiment. FIGS. 15 and 16 further detail the intermediate frame components 156. In FIG. 15, the downward protruding locking plugs 160 are bifurcated by way of central recess 170 and include a lesser diameter proximal stub 172. As the plugs 160 enter the apertures 154 the recess 170 collapses and thereby permits introduction of the proximal stub 172 within the aperture 154 and, once so positioned, expands to positively engage the aperture 154 of rails 152.

While the intermediate frame components 156 have been shown lying along the length of the longitudinal beams 152, it will be understood that such intermediate frame components 156 may be positioned laterally, i.e., across the flow of material, for screening decks having additional lateral support beams lying across the flow of material and between the beams 152. In any case, it may be appreciated that the intermediate frame components 156 may be suitably adapted in dimension to conform to whatever support beams and mounting apertures may be available in a given screening deck.

The intermediate frame components 156 may be also intermixed with other types of screen modules. In other words, the operator can deposit a screen module 50 adapted for use in connection with intermediate frame components 156 in the middle of a matrix of other screen modules. For example, those intermediate frame components 156 normally used along the outside edges of the screening deck, and having only one-half the profile of those frame components 156 interior of the screening deck, may be positioned interior of the screening deck and support a screen module 50 while allowing adjacent mounting of screen modules according to alternate mounting schemes. In this manner, the intermediate frame components 156 of the present invention allow an operator of a screening deck to employ greater variation in screen modules and screen module mounting arrangements.

Thus, a modular screen system for a screening deck has been shown and described including application to both crowned and flat screen decks. In accordance with the present invention, an intermediate frame attaches directly to the screening deck and allows selected placement of screen modules thereon. The screening system of the present invention allows snap-on mounting and snap-off dismounting of the screen modules 50. The screen modules 50 enjoy full length edge support and interior reinforcing for rigidity. The underlying screening deck need not be modified in order to receive the intermediate frame and screen modules 50 of the present invention, and may therefore be used in its conventional fashion if desired.

It will be appreciated that the present invention is not restricted to the particular embodiment that has been described and illustrated, and that variations may be made therein without departing from the scope of the invention as found in the appended claims and equivalence thereof.

What is claimed is:

1. An alternate screen arrangement for a flat screening deck, said deck including longitudinal support beams defining a plane and including a mounting arrangement for receiving a screen component, the alternate screen arrangement comprising:

a plurality of intermediate frame components mountable to said beams in the manner and in place of said screen component, said intermediate frame components having substantially straight rails including screen mounting formations therealong; and a plurality of screen modules including edge mounting formations corresponding to said screen mounting formations whereby said screen modules may be removably mounted upon said intermediate frame components, said screen modules including internal support elements transverse to said edge mounting formations.

2. A screen arrangement according to claim 1 wherein said rails provide longitudinal recess formations defining said screen mounting formations and said edge mounting formations of said screen modules engage said rails at said recess formations whereby said screen modules are supported parallel to at least two opposing edges.

3. A screen arrangement according to claim 1 wherein said frame components mount continuously said longitudinal support beams.

4. A screen arrangement according to claim 1 wherein said longitudinal support beams include mounting apertures for said screen component and said intermediate frame components include integral plug formations for removably mounting said intermediate frame components at said apertures.

5. An attachment for a screen deck including a base structure carrying support beams, said support beams being longitudinal support beams defining a flat screening deck, and a first mounting arrangement for receiving an original screen as mounted to said base structure by way of said first mounting arrangement, the attachment comprising:

an intermediate frame mountable to the first mounting arrangement of the base structure in a manner similar to and in place of the original screen, the intermediate frame defining a second mounting arrangement, the intermediate frame comprising a plurality of individual intermediate frame components mountable to and along the longitudinal support beams; and a plurality of screen modules mountable to the second mounting arrangement.

* * * * *